US007638166B2

(12) United States Patent
Wickramanayake

(10) Patent No.: US 7,638,166 B2
(45) Date of Patent: Dec. 29, 2009

(54) METHOD OF PREPARING ACTIVE LIGAND-MODIFIED INORGANIC POROUS COATINGS ON INK-JET MEDIA

(75) Inventor: Palitha Wickramanayake, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/058,507

(22) Filed: Feb. 14, 2005

(65) Prior Publication Data

US 2005/0147770 A1 Jul. 7, 2005

Related U.S. Application Data

(62) Division of application No. 10/280,686, filed on Oct. 25, 2002, now Pat. No. 6,905,729.

(51) Int. Cl.
*B05D 7/24* (2006.01)
*B05D 1/02* (2006.01)

(52) U.S. Cl. ..... 427/203; 427/204; 427/301

(58) Field of Classification Search ..... 427/180, 427/203, 204, 205, 421.1, 384, 387, 301, 427/333; 428/32.1, 32.34, 32.36, 331, 403, 428/405, 447; 524/858, 868, 869; 525/342, 525/333.7, 474, 500, 533; 528/25, 27, 28, 528/32, 38

See application file for complete search history.

(56) References Cited

U.S. PATENT DOCUMENTS

| | | | | |
|---|---|---|---|---|
| 4,946,557 | A | 8/1990 | Svending | |
| 5,179,213 | A | 1/1993 | Bradshaw et al. | |
| 5,264,275 | A | 11/1993 | Misuda et al. | |
| 5,275,867 | A | 1/1994 | Misuda et al. | |
| 5,368,833 | A | 11/1994 | Johansson et al. | |
| 5,393,892 | A | 2/1995 | Krakowiak et al. | |
| 5,411,787 | A | 5/1995 | Kulkarni et al. | 428/32.11 |
| 5,463,178 | A | 10/1995 | Suzuki et al. | |
| 5,547,760 | A | 8/1996 | Tarbet et al. | |
| 5,643,414 | A | 7/1997 | Johansson et al. | |
| 5,707,493 | A | 1/1998 | Saastamoinen | |
| 5,804,293 | A | 9/1998 | Nehmsmann et al. | |
| 5,858,280 | A | 1/1999 | Zhang et al. | |
| 5,965,244 | A | 10/1999 | Tang et al. | |
| 5,985,425 | A | 11/1999 | Tomizawa et al. | |
| 6,103,380 | A | 8/2000 | Devonport | |
| 6,110,601 | A | 8/2000 | Shaw-Klein et al. | |
| 6,183,844 | B1 | 2/2001 | Li | |
| 6,228,475 | B1 | 5/2001 | Chu et al. | 428/32.25 |
| 6,265,483 | B1 | 7/2001 | Guilard et al. | |
| 6,337,358 | B1 | 1/2002 | Whitehouse et al. | |
| 6,350,519 | B1 | 2/2002 | Devonport | |

FOREIGN PATENT DOCUMENTS

| | | | | |
|---|---|---|---|---|
| EP | 696516 | A1 | | 2/1996 |
| EP | 716929 | A1 | | 6/1996 |
| EP | 741045 | | | 11/1996 |
| EP | 0741045 | A1 | | 11/1996 |
| EP | 933225 | | | 8/1999 |
| EP | 0933225 | A1 | | 8/1999 |
| EP | 937582 | A1 | | 8/1999 |
| EP | 1 034 940 | A1 | * | 9/2000 |
| EP | 1052111 | | | 11/2000 |
| EP | 1052111 | A1 | | 11/2000 |
| JP | 59-192589 | | | 10/1984 |
| JP | 60-224580 | | | 11/1985 |
| JP | 62-032091 | | | 2/1987 |
| JP | 62-178384 | | | 8/1987 |
| JP | 08-034160 | A | * | 2/1996 |
| WO | WO 99/29513 | | | 6/1999 |
| WO | WO 01/05599 | | | 1/2001 |

* cited by examiner

*Primary Examiner*—William Phillip Fletcher, III

(57) ABSTRACT

Methods of preparing media sheets for inkjet printing applications are provided. In one embodiment, the media sheets can be prepared by dispersing or dissolving inorganic porous particulates and an active ligand-containing organosilane reagent in water; reacting the inorganic porous particulates and the active ligand-containing organosilane reagent to form media coating composition; and applying the media coating composition to a media substrate. In another embodiment, the media sheets can be prepared by coating a media substrate with inorganic porous particulates; dispersing or dissolving an active ligand-containing organosilane reagent in water to form a liquid coating composition; and applying the liquid coating composition to the inorganic porous particulates that has previously been coated on the substrate.

13 Claims, No Drawings

METHOD OF PREPARING ACTIVE LIGAND-MODIFIED INORGANIC POROUS COATINGS ON INK-JET MEDIA

This is a division of Ser. No. 10/280,686 U.S. Pat. No. 6,905,729, filed Oct. 25, 2002.

FIELD OF THE INVENTION

The present invention is drawn to methods for attaching active ligands to inorganic porous coating compositions for ink-jet media applications, as well as to chemically modified inorganic porous particulate-coated media sheets. Specifically, modification of inorganic porous media coating particulates can occur in water, followed by a coating step, or alternatively, can occur after the inorganic porous media coating particulates are already applied to a media substrate.

BACKGROUND OF THE INVENTION

Ink-jet inks typically comprise an ink vehicle and a colorant, the latter of which may be a dye or a pigment. Dye-based ink-jet inks used in photographic image printing almost always use water-soluble dyes. As a result, such dye-based ink-jet inks are usually not water fast, i.e., images tend to shift in hue and edge sharpness is reduced upon exposure to humid conditions. In addition, images created from these water-soluble dye-based ink-jet inks tend to fade over time, such as when exposed to ambient light and/or air. Pigment-based inks on the other hand, allow the creation of images that are vastly improved in humid fastness and image fade resistance. Pigment based images, however, are inferior to dye-based ink-jet inks with respect to the desirable trait of color saturation.

Print media surfaces play a key role in the fade properties and humid fastness of ink-jet produced printed images. Thus, for a given ink, the degree of fade and humid fastness can be dependent on the chemistry of the media surface. This is especially true in the case of dye-based ink-jet ink produced images. As a result, many ink-jet inks can be made to perform better when an appropriate media surface is selected.

In order for the ink-jet industry to effectively compete with silver halide photography, it is desirable that ink-jet produced images be color saturated, fade resistant, and humid fast. Thus, enhanced permanence of dye-based ink-jet ink produced images is becoming more and more integral to the long-term success of photo-quality ink-jet ink technologies. At this point in time, for instance, according to accelerated tests and "industry standard" failure criteria, photographs typically will last about 13 to 22 years under fluorescent light exposure. The best dye-based ink-jet ink printers produce prints that last for much less time under similar conditions.

A few categories of photographic ink-jet media are currently available, including polymer coated media, clay coated media, and other porous coated media. It is the polymer-coated media that provides for the longest lasting ink-jet ink produced images. However, this category of media is generally inferior in dry time and humid fastness relative to porous coated media. On the other hand, image fade resistance and humid fastness of porous coated media is generally lower than that of its polymer coated media counterpart. Therefore, there is a great desire to improve the image permanence of ink-jet ink images printed on porous coated media.

Image permanence improvements have been attempted via modification of the ink. They have also been attempted via modification of the media. Surface modification of porous media coatings is one of the methods of media modification attempted. Such modifications have been carried out in organic solvents, which can be costly and complicated at scale up, as well as pose environmental concerns. Simpler and more economical modification methods giving a desired end result would be an advancement in the art.

SUMMARY OF THE INVENTION

In accordance with embodiments of the present invention, various methods can be used to chemically modify porous inorganic particulates such that the modified particulates, when used as media coatings, provide certain advantages related to image permanence. It has been discovered that such methods can be carried out in water rather than in typical organic solvents.

Specifically, a method of preparing a media sheet for ink-jet printing applications can comprise the steps of dispersing or dissolving inorganic porous particulates and an active ligand-containing organosilane reagent in water; reacting the inorganic porous particulates and the active ligand-containing organosilane reagent to form media coating composition; and applying the media coating composition to a media substrate.

In an alternative embodiment, a method of preparing a media sheet for ink-jet printing applications can comprise the steps of coating a media substrate with inorganic porous particulates; dispersing or dissolving an active ligand-containing organosilane reagent in water to form a liquid coating composition; and applying the liquid coating composition to the inorganic porous particulates that were previously coated on the substrate.

Additional features and advantages of the invention will be apparent from the detailed description that follows.

DETAILED DESCRIPTION OF THE PREFERRED EMBODIMENT(S)

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

As used in this specification and the appended claims, the singular forms "a," "an," and "the" include plural referents unless the content clearly dictates otherwise.

"Image permanence" refers to characteristics of an ink-jet printed image that relate to the ability of the image to last over a period of time. Characteristics of image permanence include image fade, water fastness, humid fastness, light fastness, smudge resistance, air pollution induced fading, scratch and rub resistance.

"Media substrate" or "substrate" includes any substrate that can be used in the ink-jet printing arts including papers, overhead projector plastics, coated papers, fabric, art papers (e.g. water color paper), and the like.

"Porous media coating composition" typically includes inorganic particulates, such as alumina or silica particulates, bound together by a polymeric binder. Optionally, a mordant and/or other additives can also be present. The composition can be used as a coating for various media substrates, and can be applied by any of a number of methods known in the art.

"Active ligand" or "active ligand grouping" include any active portion of an organosilane reagent that provides a function at or near the surface of inorganic particles present in a porous media coating composition that is not inherent to an unmodified inorganic porous particulate. For example, an active ligand can be used to reduce the need for binder in a porous media coating composition, or can interact with a dye or other ink-jet ink component, thereby improving permanence.

"Active ligand-containing organosilane reagent" includes compositions that comprise an active ligand grouping (or portion of the reagent that provides desired modified properties to an inorganic particulate surface of the porous media coating) covalently attached to a silane grouping. Examples of active ligand groupings can include ultraviolet absorbers, metal chelators, hindered amine light stabilizers, reducing agents, hydrophobic groups, ionic groups, buffering groups, or functionalities for subsequent reactions. The active ligand group can be attached directly to the silane grouping, or can be appropriately spaced from the silane grouping, such as by from 1 to 10 carbon atoms or other known spacer groupings. The silane grouping of the organosilane reagent can be attached to inorganic particulates of the porous media coating composition through hydroxyl groups, halo groups, or alkoxy groups present on the reagent. Attachment of the reagent to the particulates can occur prior to the application of the porous media coating composition to a substrate, or can be applied after the porous media coating composition has been pre-coated onto a media substrate.

The term "lower" when referring to organic compounds or groups (when not otherwise specified) can contain from 1 to 8 carbons. For example, lower alkoxy can include methoxy, ethoxy, propoxy, butoxy, etc. Additionally, lower alkyl can include methyl, ethyl, propyl, isopropyl, butyl, t-butyl, hexyl, etc.

One advantage of the present invention is the ability to provide an active ligand grouping as part of a porous media coating wherein the active ligand grouping is at or near the surface of the inorganic particulates of the porous media coating. By the use of such compositions, the active ligand is placed in close proximity to a dye being used to print an image. Additionally, because the active ligand is at or near the surface of the particulates of the porous media coating composition, a smaller amount of active ligand may be necessary for use to provide a desired result. With these advantages in mind, it has been recognized that additional advantages can be realized by modifying inorganic particulates of a porous media coating composition using water rather than by the use of organic solvents. Active ligand-containing organosilane reagents can be used to modify inorganic particulates of porous media coating compositions either by first reacting the reagent with the inorganic particulates in water and then coating the resulting composition on a media substrate, or alternatively, coating the inorganic particulates on a media substrate and then reacting the reagent with the inorganic particulates on the media substrate.

In one embodiment, a method of preparing a media sheet for ink-jet printing applications can comprise the steps of dispersing or dissolving inorganic porous particulates and an active ligand-containing organosilane reagent in water; reacting the inorganic porous particulates and the active ligand-containing organosilane reagent to form media coating composition; and applying the media coating composition to a media substrate. In this embodiment, though not required, the active ligand-containing organosilane reagent can be added to the water in excess, followed by a further step of decanting the excess active ligand-containing reagent prior to the coating step. In another embodiment, the inorganic porous particulates can be dispersed or dissolved separately in water, and then the aqueous organosilane reagent can be mixed together for the reacting step.

In accordance with another embodiment of the present invention, a method of preparing a media sheet for ink-jet printing applications can comprise the steps of coating a media substrate with inorganic porous particulates; dispersing or dissolving an active ligand-containing organosilane reagent in water to form a liquid coating composition; and applying the liquid coating composition to the inorganic porous particulates that were previously coated on the substrate. Additives such as surfactants can be incorporated to the coating composition to enhance uniform wetting/coating. In one embodiment, the applying step can be by the application of a wash coat. Such a wash coat can be applied by a sprayer, a rod coater, or by other means.

Both of these embodiments provide for the use of water as the dispersing or dissolving agent, reaction medium, and/or reagent carrier. Preferably, no organic solvent is used. Further, the inorganic porous particulates can be part of any inorganic based porous particulate-containing material, including silica- or alumina-containing compositions. The silica- or alumina-containing composition can be coated onto a media substrate as is known in the art, and can be bound together by a polymeric binder. In some embodiments, it may be desirable to include mordants and/or other additives in the coating composition.

Regarding the active ligand-containing organosilane reagent, any reagent that provides a benefit to an ink-jet ink or printing system can be used. Examples include ultraviolet absorbers, chelating agents, hindered amine light stabilizers, reducing agents, hydrophobic groups, ionic groups, buffering groups, and functionalities for subsequent reactions.

As the methods of the present invention utilizes water as the solvent for carrying, dispersing or dissolving, or reacting the active ligand-containing organosilane reagent, in a preferred embodiment, the active ligand-containing organosilane reagent can be stable in water. An example of such a composition includes an active ligand-containing organosilane reagent having a structure in accordance with Formula 1 below:

Formula 1

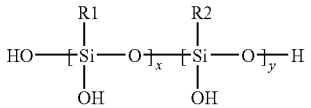

In Formula 1 above, x is preferably from 0 to 20-y, y is from 0 to 20-x, and x+y is from 1 to about 20; R1 can be lower alkyl, lower alkenyl, acrylate, or methacrylate; and R2 can be aminoalkyl, aminoalkyl salts, epoxy, epoxyalkyl, carboxyalkyl, or alkylsulfonate. Additionally, the active ligand portion (R1 and/or R2) of the active ligand-containing organosilane reagent of Formula 1 can include other active ligands than those listed above. Preferred active ligands for use include those that remain stable in water and do not prevent water solubility. Without being bound by any particular theory, it is believed that the hydroxyl groups will attach to the surface of the inorganic porous particulates of the porous media coating composition. Such attachment can occur at a single hydroxyl group, or at a plurality of hydroxyl groups.

In an alternative embodiment, though the use of water-stable active ligand-containing organosilane reagents are preferred, reagents that are reactive with water can also be used.

However, with these reagents, improved results can be obtained by faster application. For example, in embodiments where inorganic porous particulates and an active ligand-containing organosilane reagent are dispersed or dissolved and reacted together in water, application to a media substrate can occur before reagent is substantially altered by the water solvent. Additionally, in embodiments where inorganic porous particulates are first coated onto a media substrate, and then coated with the reagent, application of the reagent to the coated substrate can occur soon after the active ligand-containing organosilane reagent is dispersed or dissolved in the water. Formula 2 provides examples of active ligand-containing organosilane reagents that can accordingly be used, and is provided as follows:

Formula 2

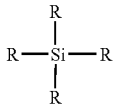

In Formula 2 above, from 0 to 2 of the R groups can be H, —$CH_3$, —$CH_2CH_3$, or —$CH_2CH_2CH_3$; from 1 to 3 of the R groups can be halo or alkoxy; and from 1 to 3 of the R groups can be an active ligand. If halo is present, then Formula 2 can be said to be an organohalosilane reagent. If alkoxy is present, then Formula 2 can be said to be an organoalkoxysilane reagent.

In accordance with Formula 2, modification of the inorganic porous particulates can occur prior to coating the inorganic porous particulates onto the media substrate, or can occur after the inorganic porous particulates are coated on the media substrate. However, in both cases, water is used as the reaction medium or carrier medium, respectively. As organoalkoxysilane reagents do generally react with water, albeit relatively slowly, the reagent in water can potentially lead to undesirable side reactions. Additionally, organohalosilane reagents react even more quickly with water than organoalkoxysilane reagents. Thus, both organoalkoxysilane reagents and organohalosilane reagents react with water at different rates, and both reagents in water can result in side reactions that can be troublesome during scale up. As a result, the timing of the method steps can be taken into account when modifying the inorganic porous particulates in accordance with methods of the present invention.

With respect to Formula 2, the active ligand can be any composition that can be part of the active ligand-containing reagent of Formula 2, provided it is compatible with water when it integrates as part of the reagent. Such active ligands can include straight or branched alkyl having from 1 to 22 carbon atoms, cyano, amino, halogen substituted amino, carboxy, halogen substituted carboxy, sulfonate, halogen, substituted sulfonate, halogen, epoxy, furfuryl, pyridyl, imidazoline derivative-substituted lower alkyl, lower cycloalkyl, lower alkyl derivatives of cycloalkyl, lower cycloalkenyl, lower alkyl derivatives of cycloalkenyl, lower epoxycycloalkyl, and lower alkyl derivatives of epoxycycloalkyl, phenyl, alkyl derivatized phenyl, phenoxy, alkyl derivatized phenoxy, quaternary amine, monoethyleneimine, or polyethyleneimine.

With respect to the inorganic porous particulates, whether modified prior to application or modified after application, the application of the inorganic porous particulates to a media substrate can be by any method known in the art. Typically, such particulates are bound together by a binder, and coated by a known method, such as air knife coating, blade coating, gate roll coating, doctor blade coating, Meyer rod coating, roller coating, reverse roller coating, gravure coating, brush coating, or sprayer coating.

EXAMPLES

The following examples illustrate various aspects of the coatings for porous ink-jet ink media substrates of the present invention. The following examples should not be considered as limitations of the invention, but should merely teach how to make the best coatings, reflecting the present invention.

Example 1

About 40 g of silica (Aerosil 200 from Degussa) was taken in about 200 g of water, and well dispersed by sonication. About 2.8 g of an organosilane reagent was provided having the formula:

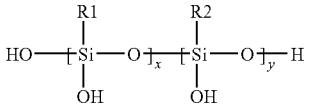

wherein x+y is about 4, and wherein R1 and R2 are aminopropyl. The organosilane reagent used included a range of oligomers having a molecular weight from about 270 MW to 550 MW. The organosilane reagent was pH adjusted to 7.0 using concentrated HCL. The organosilane reagent was then added to the water-dispersed silica with vigorous stirring. Gentle stirring was continued overnight, and the product was hand coated on to a photographic substrate and dried with a hot air gun.

Example 2

A silica composition (Aerosil 200 from Degussa) was coated on to a photographic substrate at a silica coat weight of about 25 gsm. An organosilane reagent having the following formula was provided having the formula:

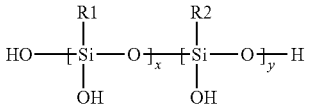

wherein x+ is about 4; the oligomer molecular weight range is from about 250 Mw to 500 Mw; R1 is aminopropyl; and R2 is methyl. Of the R1 and R2 groups, about 65% are R1 groups and about 35% are R2 groups. The organosilane reagent was diluted in water to 10% by weight. The organosilane reagent-containing solution was sprayed on the coated sheet until the coated sheet was thoroughly wet, and then was allowed to dry at ambient. Weight determination before and after the organosilane reagent coating step revealed that the organosilane reagent was coated at a coat weight in the range of 1-2 gsm.

Example 3

A silica composition (Aerosil 200 from Degussa) was coated on to a photographic substrate at a silica coat weight of about 25 gsm. The organoalkoxysilane reagent (N-(2-amino-ethyl)-3-aminopropylmethyldimethoxysilane) was taken in water at 10% by weight, quickly sprayed on to the coated sheet, and allowed to dry at ambient conditions.

Example 4

Accelerated light fade of a magenta ink printed on a substrate coated with the composition of Example 1 was measured using an industry standard method. The magenta ink was found to have an estimated light fade of about 21 years. Conversely, using the same industry standard testing method, a substrate coated with silica alone (without modification as in Example 1) and printed upon with the same magenta ink exhibited only 13 years of estimated light fade.

Example 5

Humid fastness of the modified silica material of Example 2 was evaluated. Specifically, the composition of Example 2 was coated on a paper substrate, and then, a dye-based black (composite of cyan, magenta, and yellow) ink-jet ink was printed on the coating in a straight line. As a control, unmodified silica was coated similarly on a second paper substrate, and was subsequently printed upon with the same size black line using the same ink-jet ink. Upon exposure to a temperature of 35° C. and a relative humidity of 80% for four days, the line width of each sample was measured. The black line printed on the modified silica coating of Example 2 increased about 25 times less than that of the same black line printed on the unmodified silica coating. In other words, the use of the composition of Example 2 rather than unmodified silica significantly reduced humid bleed under the above test conditions.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A method of preparing a media sheet for ink-jet printing applications, comprising:

(a) applying inorganic porous particulates to a media substrate;

(b) dispersing or dissolving an active ligand-containing organosilane reagent in water to form a liquid coating composition, wherein the active ligand-containing organosilane reagent is stable in water, and wherein the active ligand-containing organosilane reagent comprises the structure:

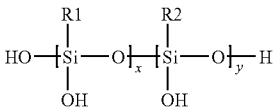

where x is from 0 to 20-y, y is from 0 to 20-x, and x+y is from 1 to about 20; R1 is lower alkyl, lower alkenyl, acrylate, or methacrylate; and R2 is aminoalkyl, aminoalkyl salts, epoxy, epoxyalkyl, carboxyalkyl, or alkylsulfonate; and (c) reacting the liquid coating composition to the inorganic porous particulates that have previously been coated on the substrate.

2. A method as in claim 1, wherein the inorganic porous particulates are silica p articulates.

3. A method as in claim 1, wherein the inorganic porous particulates are alumina particulates.

4. A method as in claim 1, wherein the applying step is by applying a wash coat.

5. A method as in claim 4, wherein the wash coat is applied by spraying.

6. A method as in claim 1, wherein the applying step is carried out by adding a polymeric binder to the inorganic porous particulates, and coating the polymeric binder and the inorganic porous particulates on the media substrate.

7. A method of preparing a media sheet for ink-jet printing applications, comprising:

(a) applying inorganic porous particulates to a media substrate;

(b) dispersing or dissolving an active ligand-containing organosilane reagent in water to form a liquid coating composition, wherein the active ligand-containing organosilane reagent is stable in water, and wherein the active ligand-containing organosilane reagent is an organohalosilane reagent; and (c) reacting the liquid coating composition to the inorganic porous particulates that have previously been coated on the substrate.

8. A method as in claim 7, wherein the inorganic porous particulates are silica particulates.

9. A method as in claim 7, wherein the inorganic porous particulates are alumina particulates.

10. A method as in claim 7, wherein the active ligand-containing organosilane reagent comprises the structure:

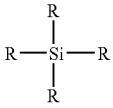

wherein from 0 to 2 of the R groups are H, —$CH_3$, —$CH_2CH_3$, or —$CH_2CH_2CH_3$; from 1 to 3 of the R groups are halo or alkoxy; and from 1 to 3 of the R groups are active ligands, wherein a halo is present.

11. A method as in claim 7, wherein the applying step is by applying a wash coat.

12. A method as in claim 11, wherein the wash coat is applied by spraying.

13. A method as in claim 7, wherein the applying step is carried out by adding a polymeric binder to the inorganic porous particulates, and coating the polymeric binder and the inorganic porous particulates on the media substrate.

* * * * *

UNITED STATES PATENT AND TRADEMARK OFFICE

CERTIFICATE OF CORRECTION

PATENT NO. : 7,638,166 B2
APPLICATION NO. : 11/058507
DATED : December 29, 2009
INVENTOR(S) : Palitha Wickramanayake It is certified that error appears in the above-identified patent and that said Letters Patent is hereby corrected as shown below:

In column 8, line 9, in Claim 2, delete "p articulates." and insert -- particulates. --, therefor.

Signed and Sealed this

Twenty-second Day of June, 2010

David J. Kappos

David J. Kappos
*Director of the United States Patent and Trademark Office*